340-566
4/27/82 XR 4,327,359

United States Patent [19]

Kurtz

[11] 4,327,359

[45] Apr. 27, 1982

[54] GLASS BREAKAGE DETECTORS EMPLOYING PIEZORESISTIVE DEVICES

[75] Inventor: Anthony D. Kurtz, Englewood, N.J.

[73] Assignee: Kulite Semiconductor Products, Inc., Ridgefield, N.J.

[21] Appl. No.: 179,509

[22] Filed: Aug. 19, 1980

Related U.S. Application Data

[63] Continuation of Ser. No. 46,263, Jun. 7, 1979, which is a continuation of Ser. No. 829,771, Sep. 1, 1977.

[51] Int. Cl.[3] ..... G08B 13/04

[52] U.S. Cl. ..... 340/545; 340/541; 340/550; 340/566; 340/665; 310/329; 328/13; 328/47; 200/61.08; 73/517 R; 73/570; 73/579

[58] Field of Search ..... 340/541, 545, 540, 550, 340/566, 571, 665, 657; 73/570, 579, 659, 654, 649, 652, DIG. 1, DIG. 4; 200/61.08; 310/329, 330, 331; 338/2, 13, 43, 47

[56] References Cited

U.S. PATENT DOCUMENTS

| | | | |
|---|---|---|---|
| 2,722,614 | 11/1955 | Fryklund | 310/329 |
| 2,963,911 | 12/1960 | Courtney-Pratt | 73/517 R |
| 3,351,880 | 11/1967 | Wilner | 73/517 R |
| 3,545,283 | 12/1970 | McGunigle | 310/329 |
| 3,582,692 | 6/1971 | Palin | 340/566 |
| 3,665,259 | 5/1972 | Brailsford | 340/566 |
| 3,693,425 | 9/1972 | Starita et al. | 73/517 R |
| 3,820,401 | 6/1974 | Lewis | 73/727 |
| 3,825,920 | 7/1974 | Nelson et al. | 340/550 |
| 3,863,250 | 1/1975 | McCluskey | 340/550 |
| 3,884,085 | 5/1975 | Beckman et al. | 73/517 R |

*Primary Examiner*—John W. Caldwell, Sr.
*Assistant Examiner*—Donnie Lee Crosland
*Attorney, Agent, or Firm*—Arthur L. Plevy

[57] ABSTRACT

A glass breakage detector includes a cantilever assembly incorporating a base member having a first beam coupled thereto. The base assembly is secured to a pane of glass with the beam extending along an axis determined by the plane contaning the glass. A piezoresistive device is positioned on the beam and adapted to change its resistance upon deflection of the beam due to the breakage of said glass and based upon the application of a vector component of force as deflecting the beam. Other embodiments employ at least another cantilever assembly also having a beam and sensor with the beam directed relatively transverse to the first beam and adapted to respond to force components normal to said vector component.

8 Claims, 6 Drawing Figures

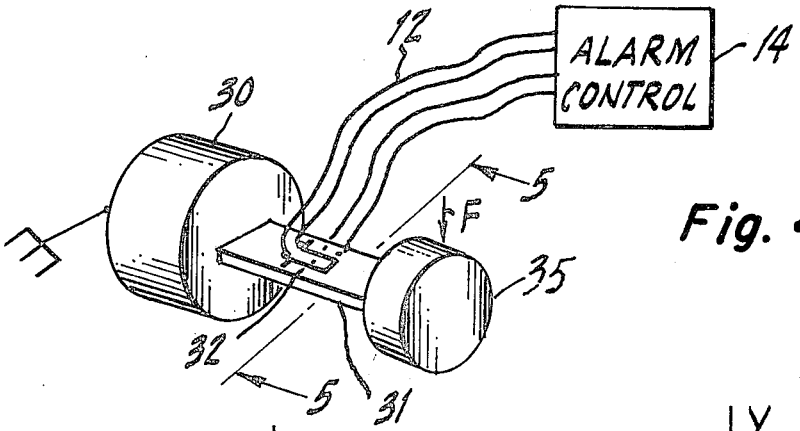
Fig. 4.
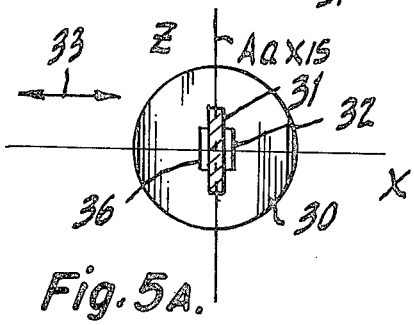
Fig. 5A.
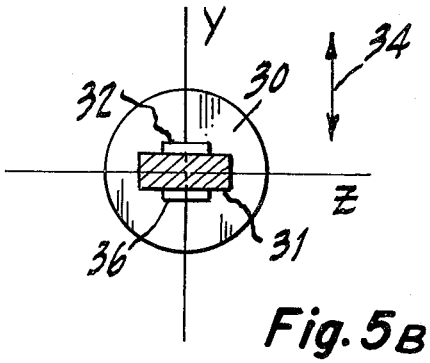
Fig. 5B.
Fig. 6.
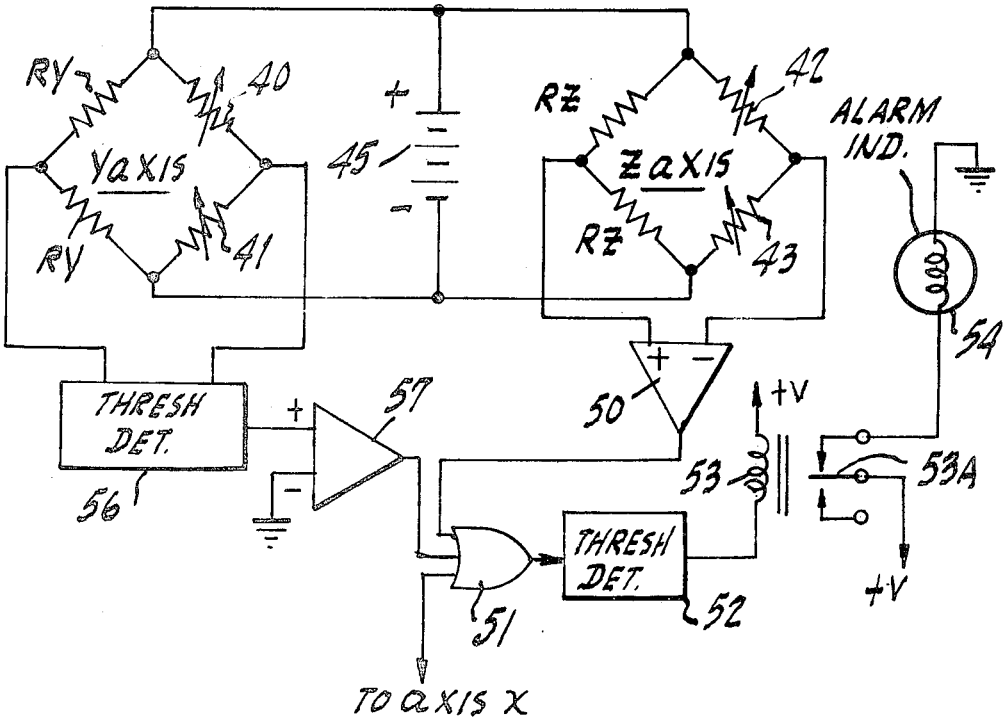

GLASS BREAKAGE DETECTORS EMPLOYING PIEZORESISTIVE DEVICES

This application is a continuation of Ser. No. 046,263 filed on June 7, 1979 which is a continuation of Ser. No. 829,771 filed on Sept. 1, 1977.

BACKGROUND OF THE INVENTION

This invention relates to a glass breakage detector and more particularly to a device for detecting a breakage of a window to set off an appropriate alarm.

The prior art is replete with various devices which are employed in intrusion detection systems to provide an alarm upon the unauthorized entry of a person, such as a burglar. Certain of these devices are used to detect the breaking or cutting of window glass to gain entry to the secured premises. Probably the most familiar of such techniques employs a conductive metal foil which is secured about the periphery of the window or glass area and if the glass is broken, the foil will also break, thus activating an alarm. This technique requires great expense in installation, cannot be reused when a window is broken, is difficult to maintain and detracts from the overall appearance of the secured premises.

To circumvent this technique, the prior art discloses alternate types of sensors which employ resonant sensing elements which detect forces or vibration of the glass surface in a plane parallel to the plane of the glass. See U.S. Pat. No. 3,899,784 entitled GLASS BREAKAGE DETECTOR issued on Aug. 12, 1975. Other devices employ the piezoelectric effect as well as other devices which employ mechanical pendulums. Each device has its own particular advantage and disadvantages in regard to tolerance operation and adjustability. Patents which relate to the principles of glass breakage detection are U.S. Pat Nos. 3,899,784, 2,884,623, 3,706,090, 1,974,779, 3,441,925, 3,634,845, as well as others too numerous to mention.

In any event, it is apparent that a major factor in employing such devices is reliability as well as the cost of producing or manufacturing such a device.

It is therefore an object of the present invention to provide an improved detector apparatus for responding to a breakage of glass; which apparatus is reliable and simple to construct and employ.

BRIEF DESCRIPTION OF PREFERRED EMBODIMENT

A glass breakage detector comprising a housing having one side secured to a surface of the glass to be monitored against breakage, said housing having another side with an aperture located on a surface thereof, and a cantilever detector mounted within said aperture, said detector comprising a base support end coacting with a beam, with said beam relatively parallel to the axis of said aperture and contained therein with said base support end being rigidly coupled to said housing within said aperture and at least one piezoresistive sensor positioned on said beam and adapted to provide a change in resistance upon the application of a force to said beam due to the breaking of said glass.

BRIEF DESCRIPTION OF FIGURES

FIG. 4 is a perspective view of a cantilever detector assembly according to the invention.

FIGS. 5A and 5B are partial front cross-sectional views depicting various mounting positions for detector assemblies.

FIG. 6 is a circuit schematic showing one type of alarm control unit.

DETAILED DESCRIPTION OF FIGURES

Figure 1:
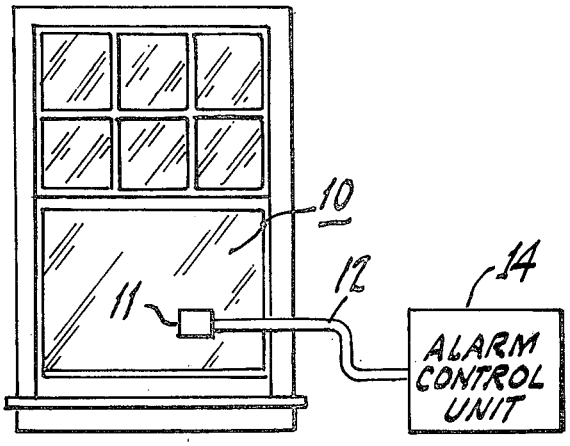
FIG. 1 is a diagrammatic view of a window and a glass breakage detector according to this invention.

Referring to FIG. 1, there is shown a representation of a conventional type of window employing a glass pane 10 which is to be protected by a glass breakage detector 11 according to this invention.

Essentially, the glass breakage detector comprises a rectangular or other suitable shaped housing which is extremely small and may, for example, be one inch or less in length and width and approximatley one-quarter inch or less in thickness. The unit is placed on the glass 10 at a suitable distance from the bottom of the pane and the side which may be ten inches for each location.

The unit contains a cable 12 which is directed to an alarm control unit 14, as will be further explained.

The unit to be described, can protect a relatively large glass area and provide a signal to the alarm control unit 14 when glass is broken or as will be further explained tampered with in any substantial manner.

As can be seen from FIG. 1, the unit 11 is extremely small as compared to the overall dimension of the glass 10 and hence, does not detract from the appearance of the window or from the viewing area. While a particular window is shown, it is understood that this configuration is only by way of example and other glass-enclosed areas such as doors, walls and so on, can be similarly protected.

Figure 2:
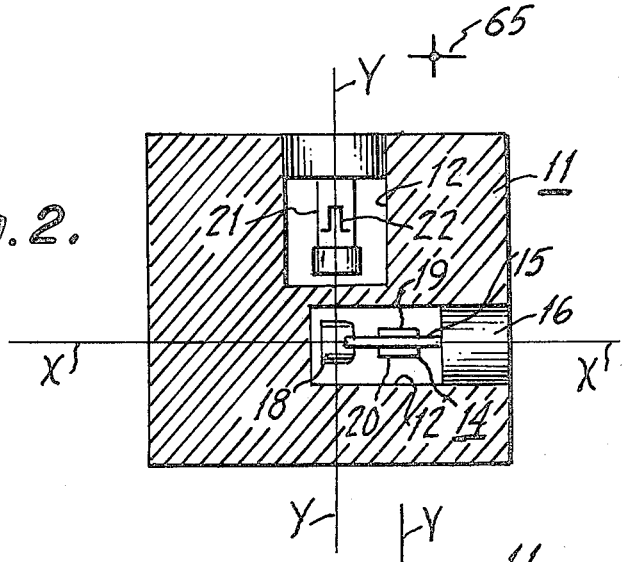
FIG. 2 is a cross-sectional view of a housing incorporating cantilever detectors according to this invention.

Referring to FIG. 2, there is shown a cross-sectional view of a typical housing as 11. Essentially, the housing 11 may be fabricated from a plastic or a metal or any other type of material. The housing, as shown for example, in FIG. 3, may contain a hole or apertures as 12 on one or more surfaces which, in essence, correspond to an X,Y, and Z axis.

A detector device according to this invention is then inserted into one or more of the apertures and secured therein in a particular orientation, as will be described.

Referring to FIG. 2, it is seen that each aperture as 12 along a particular axis, does not extend through the housing but extends into the housing towards the center thereof. A detector device 14 is then inserted and secured into each aperture.

Basically, the detector device comprises a cantilever structure or beam 15. The beam 15 is rigidly coupled to a reference block 16; which block is glued or otherwise firmly positioned within the aperture 12 of the housing. The cantilever beam is preferably fabricated from silicon or a suitable semiconductor material with a high modulus of elasticity.

The free end of the cantilever beam 15 accommodates a mass 18 which serves to determine the overall characteristics of the beam.

Located on a top surface of the beam 15 is a first piezoresistive sensing element 19. The element 19 may be bonded directly to the beam or may be diffused into the beam by suitable semiconductor techniques. Located beneath the sensor 19 is another sensor 20 which is mounted upon the beam by the same technique as briefly described above.

It is shown in this example that the thin portion of the beam 15 is aligned along the X axis. Located in aperture 12 associated with the Y axis is still another cantilever sensor configuration 21. Cantilever 21 is of similar construction to the cantilever member 14 and also has sensor element 22 located on the top and one located directly beneath element 22. There also may be a similar sensor inserted into an aperture as 12 associated with the Z axis.

Figure 3:
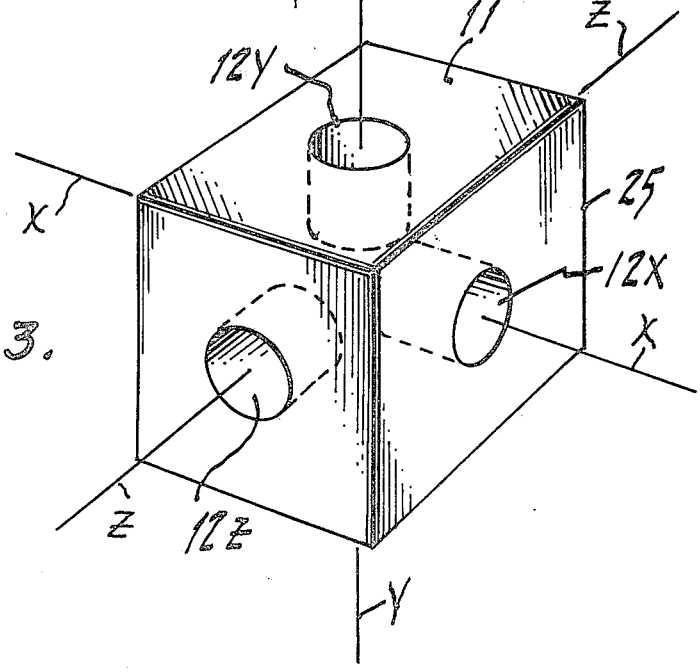
FIG. 3 is a perspective view of a housing employed in this invention.

The housing 11 as shown in FIG. 3 can be secured to the glass pane by means of a suitable adhesive as 25 such as the double-backed adhesives which are well known and commercially available.

Referring to FIG. 4, there is shown a perspective view of a typical cantilever detector such as those shown in FIG. 2 as 14 and 21. Essentially, the cantilever structure includes a front or a support end 30. The support end 30 coacts with the beam portion 31 which is further coupled to the mass 35 as shown in FIG. 4, and the entire assembly can be fabricated from metal with piezoresistive transducer bonded on the metal beam portion.

Alternatively, the entire structure can be fabricated from a rod of semiconductor material such as silicon. In essence, the beam portion 31 would be machined or etched into the silicon rod to define a central area 33 of narrow dimensions when compared to the support 30 or the mass 35. Thus, employing silicon for the entire structure, one can then diffuse the piezoresistive element 32 directly into the beam portion 31.

Not shown, but located beneath sensor 32 is an additional sensor. As one can see briefly from FIG. 4, if a force F were applied at the mass end, and the cantilever were supported at the support end 30, the sensor 32 would be in tension while the sensor located beneath the same would be in compression. Hence, the apparatus shown in FIG. 4 will provide a change in resistance of both sensors based upon the magnitude of the force F.

FIG. 5A shows an end view of a cantilever sensor taken as a cross-section before the mass 35. Essentially, the sensor 30 may be mounted in a suitable aperture of housing 11 so that the beam 31 has its thin dimension located parallel to the Z axis and perpendicular to the X axis. The sensor would thus be placed in aperture 12 associated with the Z axis in the orientation shown in FIG. 5A.

It thus will be apparent that the structure will be extremely sensitive to force applied in the direction of arrow 33 or to forces which occur within the plane of the window or glass.

Another orientation is shown in FIG. 5B where the thin side of the beam 31 is directed along the Z axis with the thicker side perpendicular to the Y axis. It can be seen that the cantilever as positioned in the housing, for example, in aperture 12X, would be sensitive to forces applied in the direction of arrow 34.

Similarly, a sensor can also be inserted in the 12Y aperture in a suitable configuration and as shown in FIG. 2 for example, would be sensitive to forces in and out of the plane of the window as shown in FIG. 2 by reference numeral 65.

As indicated, each beam has a sensor as 32 mounted on the thick portion of the beam on one side and an opposite sensor as 36 mounted on the opposite side. Thus, one sensor is in compression while the other sensor is in tension for an applied force.

It can be immediately seen that when the housing 11 is mounted on the window, any force which is sufficient to break the window will cause at least one of the sensors to deflect, thus causing the piezoresistors to exhibit a change in resistance and hence produce a signal for such a deflection. Since a force applied to the window will have vector components along all axes, each cantilever detector will so respond and produce a combined output indicative of the breaking of the glass.

It is also noted that the major components of force in accommodating a breaking of the glass will occur along the Z axis for forces perpendicular to the window and hence, the transducer which is mounted in aperture 12Y will exhibit the greatest resistance change. The transducer cantilever assembly which is mounted in aperture 12Z will also experience a large force component and hence, produce a relatively large resistance change. For most purposes, it would be sufficient to employ only two transducers in conjunction with the housing as shown in the Figures as 11.

In any event, the use of a cantilever beam configuration in conjunction with such a housing enables one to provide many features in conjunction with a glass breakage detector, which are not easily provided by any of the prior art devices. For example, many prior art devices operate by resonating at a frequency associated with the breaking of glass. An easy way to circumvent the operation of such devices is to actually and carefully cut a hole in the glass at a location removed from the location of the sensor. By cutting such a hole and further assuring that the glass does not break, a burglar can defeat sensor operation and gain entry to the premises. In the present embodiment, the force imparted to the glass by a glass cutter would immediately cause an indication from the sensor mounted in aperture 12Y.

Another way of circumventing the operation of such sensors is by cutting a hole in the glass about the sensor and then carefully removing the sensor prior to entry on the premises. This technique can be employed in frequency sensitive devices as well as certain mechanical vibrating devices.

In this configuration, if a hole were cut about the housing 11 when mounted on the window plane, the burglar upon the slightest tilt of the structure, would deflect one of the sensors and hence, cause an alarm indication. To further assure that this problem is circumvented, the sensor configuration shown in FIG. 5A is fabricated to be much thinner in cross-section than the sensor for example, in FIG. 5B. Thus, the mere tilting of the housing would cause the sensor shown in FIG. 5A to deflect immediately in the above described situation.

Furthermore, it is known and desireable that certain constraints be placed on such devices so as not to provide false alarms during normal operation. In this manner, due to the location of the sensors, such operation can be carefully guarded against as, for example, if one opened a window without breaking the glass by merely using the window in ordinary use, a major force would be experienced by the sensor as shown in FIG. 5B, for example, and located in aperture 12X. Thus, if this sensor provided an extremely large output as compared to the sensors located in 12Y and 12Z, one could discriminate and determine that this was not an alarm condition. The implementation of such circuitry to do so is extremely simple and well within the ken of the ordinary designer.

Furthermore, the fabrication of the cantilever structure for each axis can be controlled as to both the width and the length of the beam to obtain different sensitivities based upon the nature of the expected type of intrusion. Thus, for example, if one wished to protect the glass against breakage by missiles such as a rock or a brick and so on, one could anticipate a major force along the Z axis and hence, design the cantilever assembly located in aperture 12Y to be less sensitive than those located in apertures 12X and 12Z. In this manner, one could therefore discriminate against forces which are normal to the plane of the glass but which are not of sufficient magnitude to break the glass and hence, a slight rapping or tapping on the window would not cause an alarm. A major advantage of this type of sensor as compared to other sensors is concerned with the electric signal, whereas other sensors provide an open circuit and hence, such sensors may be circumvented by cutting the cable as 12 associated with the sensor.

Referring to FIG. 6, there is shown a circuit configuration of a typical alarm control unit such as 14 which may be employed in conjunction with the detector device above described. For purposes of ease of explanation, a Y axis and a Z axis sensor circuit configruation will be referred to.

Essentially as indicated, each cantilever beam has a top sensor such as 40 and a bottom sensor 41 shown in FIG. 6 as associated with a Wheatstone bridge manifesting a detector placed along the Y axis. As indicated, the sensors 40 and 41 are piezoresistors whose resistance varies according to the magnitude of a force applied to the sensor. Each resistor as 40 and 41 may comprise one arm of the bridge, while two fixed resistors such as R-Y comprise other arms of the bridge.

Similarly, the Z axis configuration also consists of a bridge arrangement which includes resistors 42 and 43 as the piezoresistive sensors associated with the cantilever detector along the Z axis. Each bridge is biased by means of a source of potential 45 which may be a power supply or a rechargeable battery. The output of each bridge is coupled to suitable detecting circuits, as will be explained.

Essentially, the sensor block as 11 is mounted on the windows or the glass to be protected as above described. If the glass is broken, each cantilever will be subjected to a force based on the direction of the axis along which it is mounted. The force will thus cause an unbalance of resistance in the bridge and produce a voltage across the output of the bridge.

In the case of the Z axis detector, the output of the bridge is applied to an operational amplifier 50. The amplifier 50 may be a conventional integrated circuit and many examples exist and are readily commercially available. The output of the operation amplifier 50 is applied to an OR gate 51. The output of the OR gate 51 is directed to a threshold detector 52.

The function of the threshold detector is to provide a given DC level when the output of gate 51 exceeds a predetermined value. Many examples of threshold detectors exist in the prior art such as Schmitt triggers, operational amplifiers employing reference levels and so on.

If the threshold detector 52 is exceeded, it will provide a level at its output which is sufficient to operate a relay coil as 53. The coil 53 will activate the contact 53A to thus apply power to an alarm 54. The alarm 54 is shown generally as a lamp, but of course, can be a bell, siren or any other type of alarm conventionally employed and used in intrusion systems to provide an indication of an unauthorized intrusion.

It is noted that the output of the Y axis Wheatstone bridge is applied directly to a threshold detector 56. For example and as described above, the Y axis detector is sensitive to forces directed normal or perpendicular to the glass. Hence, the sensitivity of the Y detector to such forces can be further controlled by imposing a greater threshold of operation on this sensor. When the voltage on the threshold detector 56 exceeds a predetermined value which is indicative of a force capable of breaking the glass, the output of this detector is directed through an amplifier 57 to the OR gate 51. If this signal is sufficient to exceed the threshold imposed by detector 52, the relay 53 will again be operated.

Thus, as can be seen, a large force along the Y axis will cause the relay 53 to activate to send an alarm. A smaller force along the Z axis will also cause the relay to operate. A combined force along both the Y and the Z axes can also cause the relay to operate. Hence, it can be seen simply from the above FIGURE, that one many tailor the characteristics of each cantilever associated with each axis to accommodate the particular condition required by the premises.

As indicated above, the threshold detector 56 for example, may be set such that normal force which is used to open the window would not be sufficient to sound an alarm without a substantial accompanying force along the Z or the X axis and hence, the apparatus depicted can easily discriminate against normal uses of such windows as compared to unauthorized uses.

It is further noted that a single cantilever mounted along the Y axis can be employed in many installations where it is desired to indicate the breaking of a window in order to control vandalism and so on. The utility of such configurations should be apparent to one skilled the art with the further fact that devices as being fabricated from silicon are simple and easy to produce as well as they lend themself to mass production techniques conventionally employed in integrated circuit technology. Based on such considerations, the devices are extremely small while providing the user with a multiplicity of applications in regard to glass breakage detectors which are not readily available by the use of prior art devices.

I claim:

1. A glass breakage detector adapted to be mounted on a vertical plane of glass associated with a conventional movable window pane, comprising:

(a) a rectangular housing having a first sidewall with a first aperture located therein and generally parallel to said vertical plane of glass, an adjacent sidewall having a second aperture generally transverse to said plane of glass, (b) a first cantilever detector having a cylindrical base support end coacting with a first flexible beam, with said first beam located in said first aperture with said base support end rigidly coupled to said housing, said beam having positioned thereon at least one piezoresistive element, with the thickness of said beam in said first aperture being of a predetermined value, permitting it to deflect upon application of a force thereto in a plane parallel to said vertical plane, whereby said sensor provides a change in resistance according to said deflection, (c) a second cantilever detector having a cylindrical base support and coacting with a second flexible beam with said second beam located in said second aperture with said base support end rigidly coupled to said housing, said second beam having positioned thereon at least one piezoresistive element, with the thickness of said second beam substantially greater than the thickness of said first beam, permitting it to deflect for application of substantially larger forces thereto in a plane transverse to said vertical plane, whereby said sensor provides a change in resistance according to said deflection, (d) logic means coupled to said sensors associated with said first and second beams to monitor said resistance change to provide an alarm when simultaneous forces are applied to said sensors, whereby when said window is moved conventionally, said logic means as coupled to said sensors inhibit alarm operation.

2. The glass breakage detector according to claim 1 wherein said first and second beams are fabricated from silicon and are integrally formed with said base support member, with said piezoresistive sensor diffused into a surface of said beam.

3. The detector according to claim 1 wherein said housing has another aperture on a side perpendicular to said first and second sides, with another cantilever detector mounted within said another aperture, said detector having a beam directed along the axis of said another aperture and perpendicular to said axis of said other apertures and at least one piezoresistive sensor mounted on said beam and responsive to provide a change in resistance for forces due to the breaking of glass as related to said axis of said another aperture.

4. A glass breakage detector, comprising:

(a) a first cantilever detector having a base support member rigidly secured to said glass and a first beam coupled to said base support member and directed along a plane parallel to the plane of said glass, said first beam having positioned thereon at least one piezoresistive sensor adapted to provide a change in resistance for forces sufficient to deflect said beam upon breakage of said glass, (b) a second cantilever detector having a base support member rigidly secured to said glass and a second beam coupled to said support member and directed along a plane transverse to the plane of said glass, said second beam having positioned thereon at least one other piezoresistive sensor adapted to provide a change in resistance for forces sufficient to deflect said second beam upon breakage of said glass, and (c) logic means coupled to said sensors associated with said first and second cantilever detectors to monitor said resistance changes and to provide an alarm when forces sufficient to break said glass are applied to both sensors, whereby said logic means discriminates against typical forces applied to said glass during conventional conditions as when said window is moved conventionally to cause said logic means as coupled to said sensors to inhibit alarm operation.

5. The glass breakage detector according to claim 4 wherein said second beam is thinner in cross section than said first beam.

6. The glass breakage detector according to claim 4 wherein said first and second beams are fabricated from silicon with said sensors diffused in a surface thereof.

7. The glass breakage detector according to claim 4 wherein said first and second beams are fabricated from metal with said sensors bonded to said respective beam.

8. The glass breakage detector according to claim 4 wherein said logic means comprises a first threshold detector coupled to said second cantilever and operative to provide a first output signal when said sensor associated with said cantilever provides a change in resistance exceeding said first threshold level, a second threshold detector having a lower threshold level than said first threshold level, with said first threshold detector and said first cantilever coupled to an input of said second threshold detector, said second threshold detector operative to provide an output when said first threshold detector provides its output signal or when said second cantilever exceeds a predetermined value, and means coupled to said second threshold detector to activate an alarm.

* * * * *